US006634502B1

(12) United States Patent
Yu

(10) Patent No.: US 6,634,502 B1
(45) Date of Patent: Oct. 21, 2003

(54) RETRIEVING STRUCTURE OF STORAGE DEVICE USED FOR KEEPING THE TURNING PARTS OF HAND TOOL

(75) Inventor: Hong-Chow Yu, Ta Li (TW)

(73) Assignee: Shu-Ju Chen, Taichung (TW)

( * ) Notice: Subject to any disclaimer, the term of this patent is extended or adjusted under 35 U.S.C. 154(b) by 0 days.

(21) Appl. No.: 10/259,081

(22) Filed: Sep. 26, 2002

(51) Int. Cl.[7] ..... B65D 85/28
(52) U.S. Cl. ..... 206/379; 206/372
(58) Field of Search ..... 206/372–379, 206/349, 817; 211/69, 70.6; 221/86–89, 91

(56) References Cited

U.S. PATENT DOCUMENTS 5,071,346 A * 12/1991 Domaas ..... 206/379
5,535,882 A * 7/1996 Liu ..... 206/377
5,711,428 A * 1/1998 Ho ..... 206/738
6,415,923 B1 * 7/2002 Chen ..... 206/379
6,547,074 B1 * 4/2003 Chen ..... 206/379

* cited by examiner

*Primary Examiner*—Luan K. Bui
(74) *Attorney, Agent, or Firm*—W. Wayne Liauh

(57) ABSTRACT

A storage device is used for keeping a plurality of turning parts of a hand tool and is formed of a base and a rotating seat mounted rotatably on the base. The base is provided with a plurality of urging blocks, each being pivoted at a bottom end in a locating slot and provided with two action inclined faces contiguous to and corresponding in inclination to each other. The urging blocks are further provided in the bottom end with two offset inclined faces contiguous to and corresponding in inclination to each other. The turning parts kept in the retaining slots of the rotating seat are urged by the urging blocks to ascend along the action inclined faces of the urging blocks at the time when the rotating seat is turned in relation to the base.

4 Claims, 11 Drawing Sheets

RETRIEVING STRUCTURE OF STORAGE DEVICE USED FOR KEEPING THE TURNING PARTS OF HAND TOOL

FIELD OF THE INVENTION

The present invention relates generally to a storage device used for keeping the turning parts of a hand tool, and more particularly to a retrieving structure of the storage device.

BACKGROUND OF THE INVENTION

As shown in FIG. 1A, a storage device of the prior art comprises a rotating seat 1 and a protective cover 3. The rotating seat 1 is fastened pivotally at one end with the protective cover 3 and is provided in the interior with a plurality of retainers 2, each being used to hold a turning part "A", such as a screwdriver tip, as shown in FIG. 1B. In order to retrieve the turning part "A" from the rotating seat 1, one must swivel the rotating seat 1 in relation to the protective cover 3 so as to uncover the turning part "A", which is then exerted on one end by an external force to cause other end of the turning part "A" to move upward to facilitate the removing of the turning part "A" from the retainer 2, as illustrated in FIG. 1B. It is conceivably inconvenient for a worker to use the prior art storage device described above.

SUMMARY OF THE INVENTION

The primary objective of the present invention is to provide a storage device with a retrieving structure which is designed to facilitate the retrieving of the turning parts of a hand tool from the storage device.

In keeping with the principle of the present invention, the foregoing objective of the present invention is attained by a rotary storage device comprising a base, a rotating seat, and a cover. The base is provided with a central axis and a plurality of urging blocks, each having two action inclined faces corresponding in inclination to each other. The rotating seat is rotatably mounted on the base such that the rotating seat turns around the central axis of the base. The rotating seat is provided in the interior with a series of retaining slots, and insertion slots in communication with the retaining slots and corresponding in location to the urging blocks of the base. The retaining slots are used to hold the turning parts of a hand tool. The cover is mounted rotatably on the top end of the central axis of the base such that the cover is located on the top of the rotating seat. In operation, the rotating seat is turned in relation to the base, the turning parts of the hand tool are urged by the urging blocks of the base via the insertion slots of the rotating seat, thereby resulting in the upward movement of the turning parts along the action inclined faces of the urging blocks. As a result, the top ends of the turning parts of the hand tool are caused to jut out of the retaining slots of the rotating seat.

The foregoing objective of the present invention is further attained by a drawer-type storage device comprising a housing and a sliding seat which is slidably disposed in the interior of the housing. The housing is provided with an urging block having two inclined faces. The sliding seat is provided with a series of retaining slots, and an insertion slot in communication with the retaining slots and corresponding in location to the urging block of the housing. The retaining slots are used for keeping the turning parts of a hand tool. As the sliding seat is drawn out, the turning part is urged by the urging block via the insertion slot such that the turning part moves upward along the inclined face of the urging block so as to jut out of the retaining slot.

The present invention is characterized by the urging block which is provided in the bottom end with a first offset inclined face and a second offset inclined face. The bottom end of the urging block is movably disposed in a locating slot of the base or housing. The two action inclined faces have an inclination of 30 degrees while the two offset inclined faces have an inclination of 15 degrees. With the inclination of the action inclined faces of the urging blocks being 30 degrees, the rotating or sliding seat of the present invention can be provided with a greater number of the retaining slots. The two offset inclined faces serve to compensate the two action inclined faces, so as to enable the turning parts of the hand tool to ascend effectively along the 30-degree action inclined faces.

The features and the advantages of the present invention will be more readily understood upon a thoughtful deliberation of the following detailed description of two preferred embodiments of the present invention with reference to the accompanying drawings.

DETAILED DESCRIPTION OF THE PREFERRED EMBODIMENTS

Figure 1A:
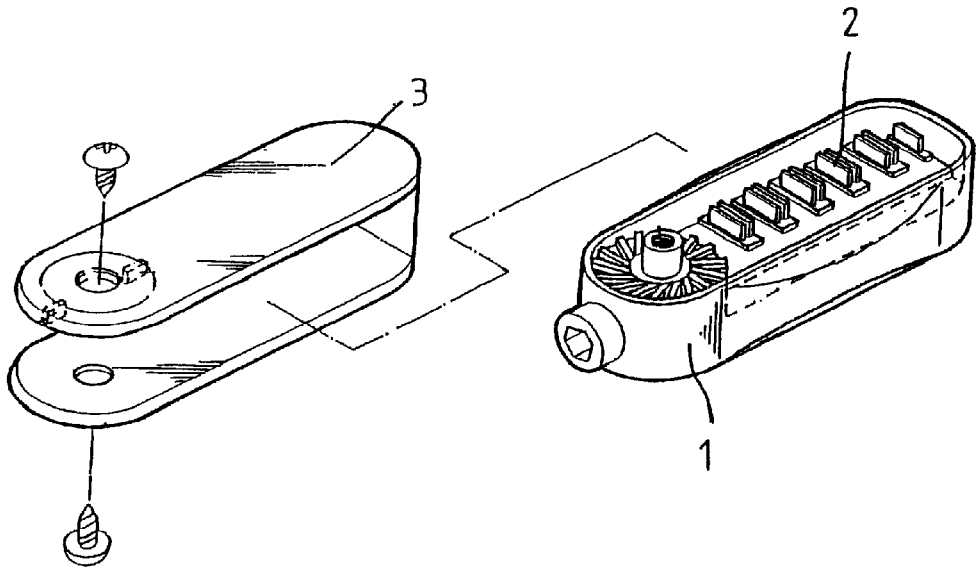
FIG. 1A PRIOR ART
FIG. 1A shows an exploded view of a prior art storage device.
Figure 1B:
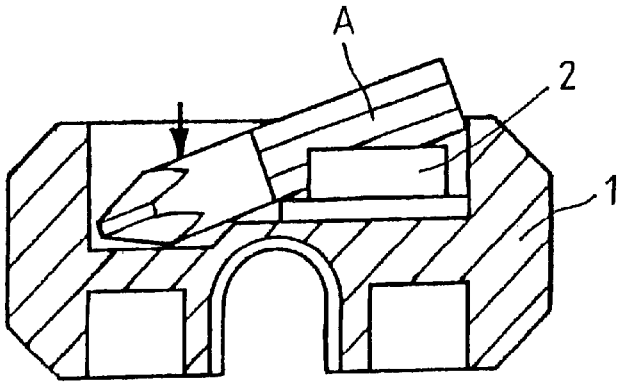
FIG. 1B PRIOR ART
FIG. 1B shows a schematic view of the prior art storage device at work.
Figure 2:
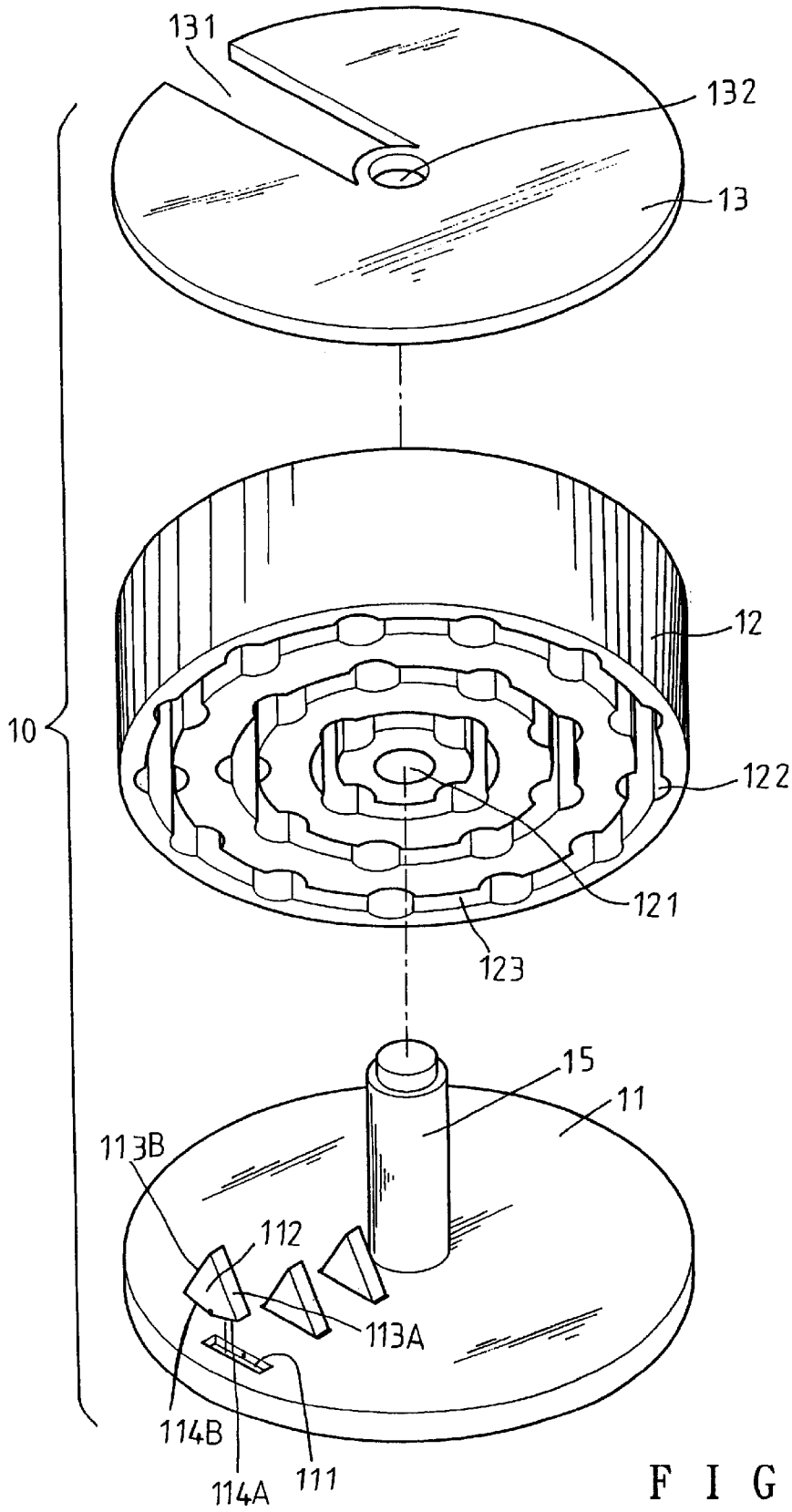
FIG. 2 shows an exploded view of a first preferred embodiment of the present invention.

As shown in FIG. 2, a rotary storage device 10 embodied in the present invention comprises a base 11, a rotating seat 12, and a cover 13.

Figure 3:
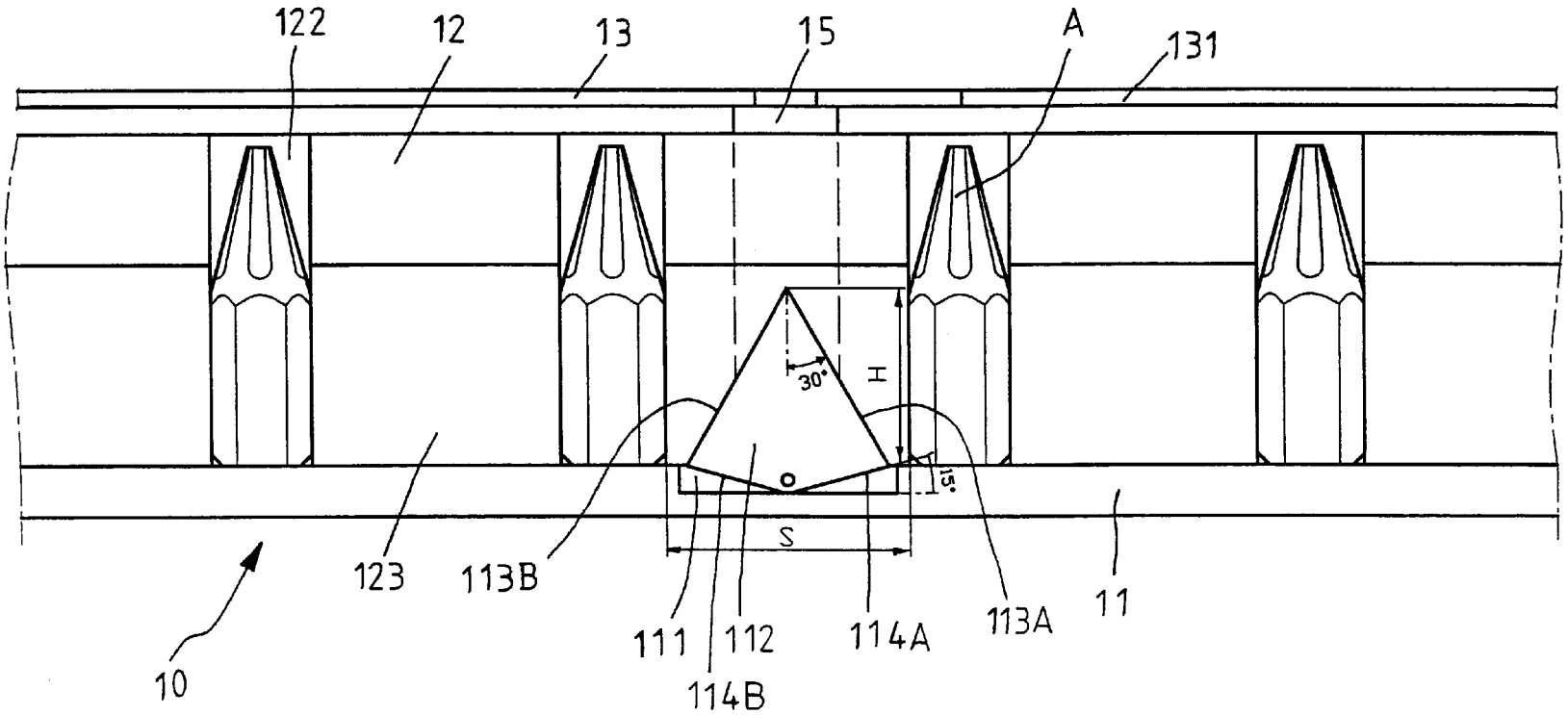
FIG. 3 shows a schematic plan view of the first preferred embodiment of the present invention.

The base 11 is provided in the upper side with a central axis 15, a plurality of locating slots 111, and a plurality of urging blocks 112 corresponding in number to the locating slots 111. The urging blocks 112 are movably located in the locating slots 111. As shown in FIG. 3, the urging blocks 112 have a bottom end, which is movably located in the locating slot 111 and is provided with a first offset inclined face 114A and a second offset inclined face 114B contiguous to the first offset inclined face 114A. Both the first offset inclined face 114A and the second offset inclined face 114B have an inclination of 15 degrees. The urging blocks 112 are further provided with a first action inclined face 113A contiguous to the first offset inclined face 114A, and a second action inclined face 113B contiguous to the first action inclined face 113A and the second offset inclined face 1114B.

The rotating seat 12 is provided in the interior with a series of retaining slots 122, and insertion slots 123 in communication with the retaining slots 122 and corresponding in location to the urging blocks 112 of the base 11. The rotating seat 12 is provided at the center with a through hole 121 and is rotatably mounted on the base 11 such that the through hole 121 of the rotating seat 12 is fitted with the central axis 15 of the base 11, thereby enabling the rotating seat 12 to turn around the central axis 15 of the base 11. The retaining slots 122 are used to hold the turning parts "A" of a hand tool, such as screwdriver tips, as shown in FIG. 3.

The cover 13 is provided with a through slot 131 corresponding in location to the retaining slots 122 of the rotating seat 12, and a center through hole 132. The cover 13 is rotatably mounted on the top of the rotating seat 12 such that the center through hole 132 is fitted with the top end of the central axis 15 of the base 11.

Figure 4A:
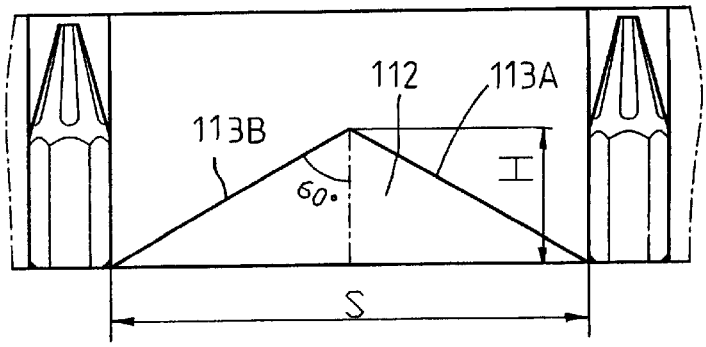
FIG. 4A shows a schematic plan view of 60-degree action inclined faces of the urging block in relation to the distance between two retaining slots of the first preferred embodiment of the present invention.
Figure 4B:
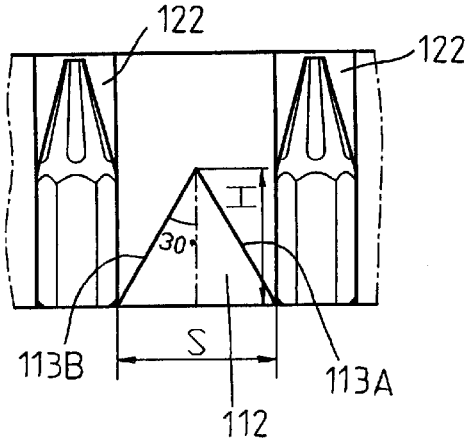
FIG. 4B shows a schematic plan view of 30-degree action inclined faces of the urging block in relation to the distance between the two retaining slots of the first preferred embodiment of the present invention.
Figure 4C:
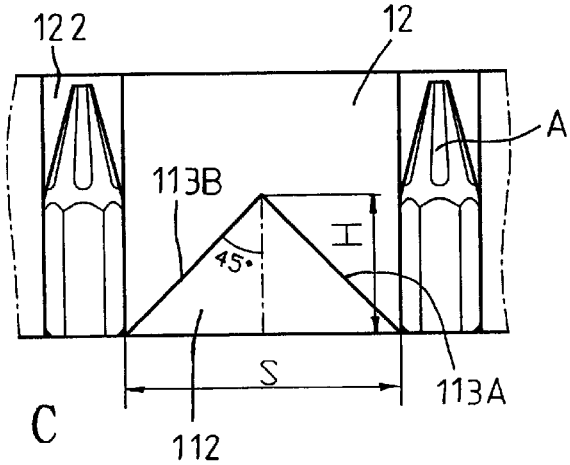
FIG. 4C shows a schematic plan view of 45-degree action inclined faces of the urging block in relation to the distance between the two retaining slots of the first preferred embodiment of the present invention.

As illustrated in FIGS. 4A, 4B and 4C, the number of the retaining slots 122 of the rotating seat 12 is dependent on inclination of the first action inclined face 113A and the second action inclined face 113B. It is apparent that the rotating seat 12 can be provided with the greatest number of retaining slots 122 in a situation in which the first action inclined face 113A and the second action inclined face 113B of the urging blocks 112 have an inclination of 30 degrees, thanks to the smallest distance "S" between the two retaining slots 122 as illustrated in FIG. 4B. However, as far as the ascending effect of the action inclined faces of the urging blocks 112 is concerned, the inclination of 45 degrees can provide the optimal ascending effect. The urging blocks 112 of FIGS. 4A, 4B, and 4C are identical in height (H).

In light of the fact that the inclination of 30 degrees results in an increase in number of the retaining slots 122, and that the inclination of 45 degrees provides the best ascending effect, the first action inclined face 113A and the second action inclined face 113B of the urging blocks 112 have an inclination of 30 degrees, as shown in FIG. 3. In the meantime, the first offset inclined face 114A and the second offset inclined face 114B of the urging blocks 112 have an inclination of 15 degrees.

Figure 5:
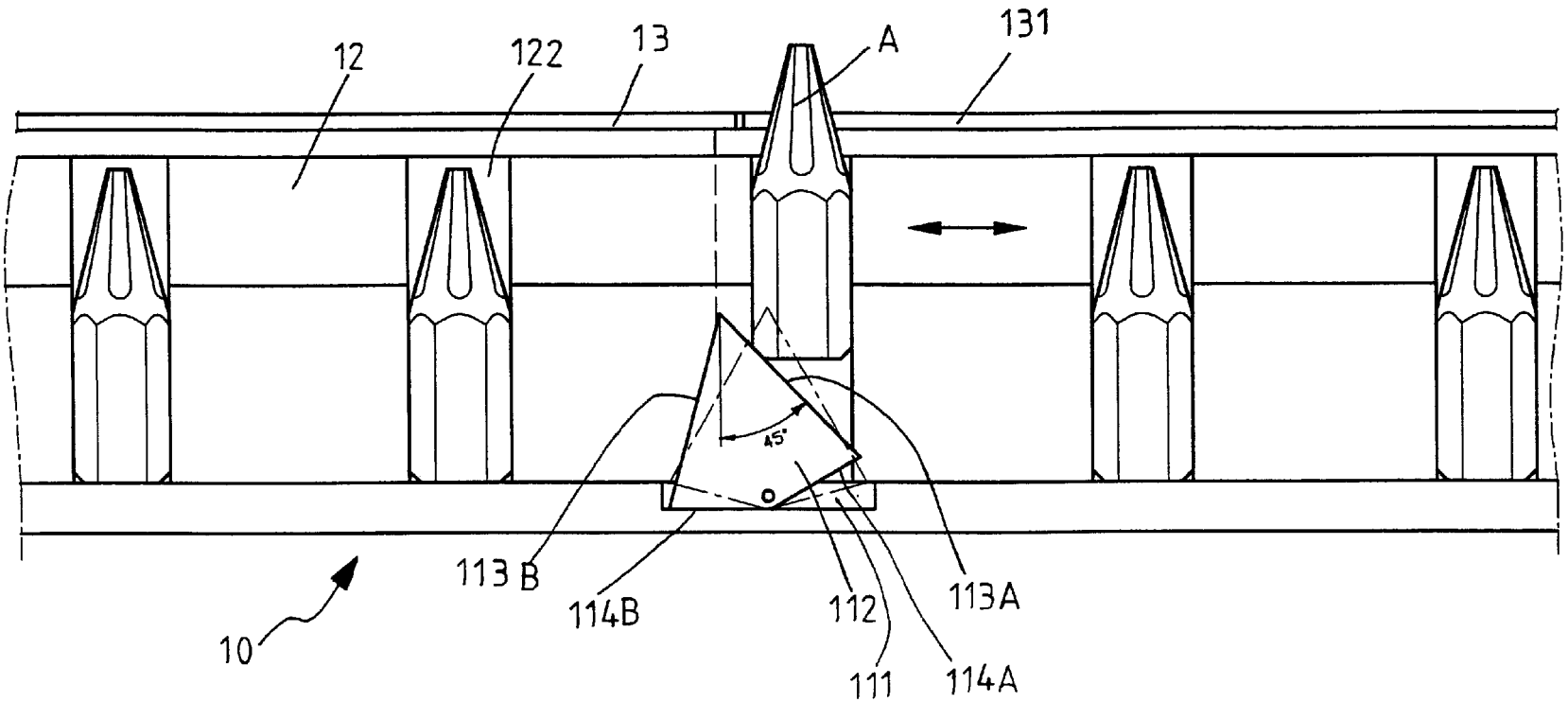
FIG. 5 shows a schematic plan view of the ascending effect of the first preferred embodiment of the present invention.
Figure 6:
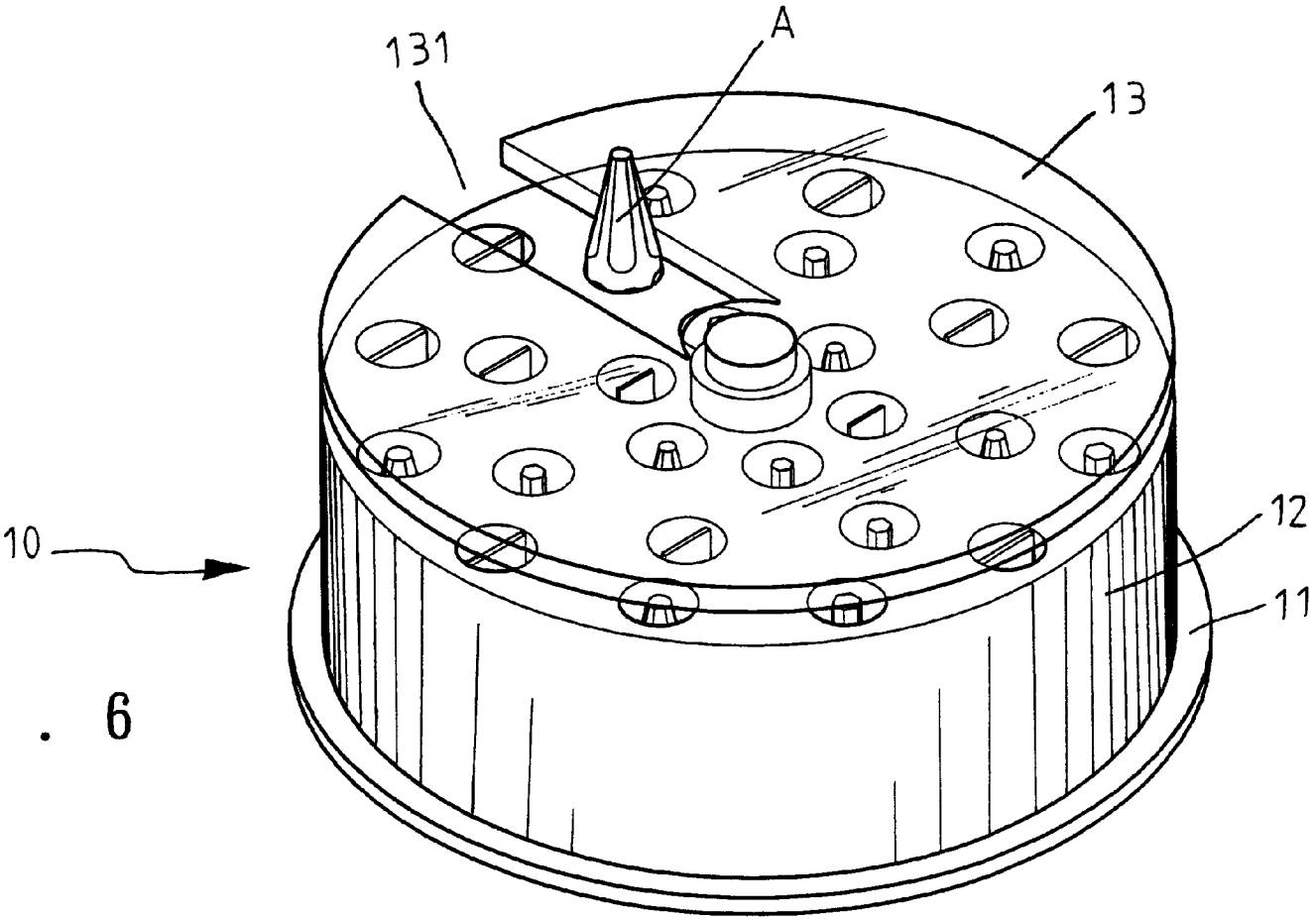
FIG. 6 shows a perspective view of the first preferred embodiment of the present invention in its entirety.

In operation, when the rotating seat 12 is turned in relation to the base 11, the turning part "A" of the hand tool is urged by the urging block 112 to ascend along the first action inclined face 113A, as shown in FIG. 5. As the ascending process of the turning part "A" is in progress, the turning part "A" exerts pressure on the urging block 112, thereby causing the urging block 112 to swivel in such a manner that the second offset inclined face 114B comes in contact with the inner bottom wall of the locating slot 111 of the base 11, as shown in FIG. 5. As a result, the 30-degree first action inclined face 113A is capable of providing a 45-degree ascending effect.

Figure 7:
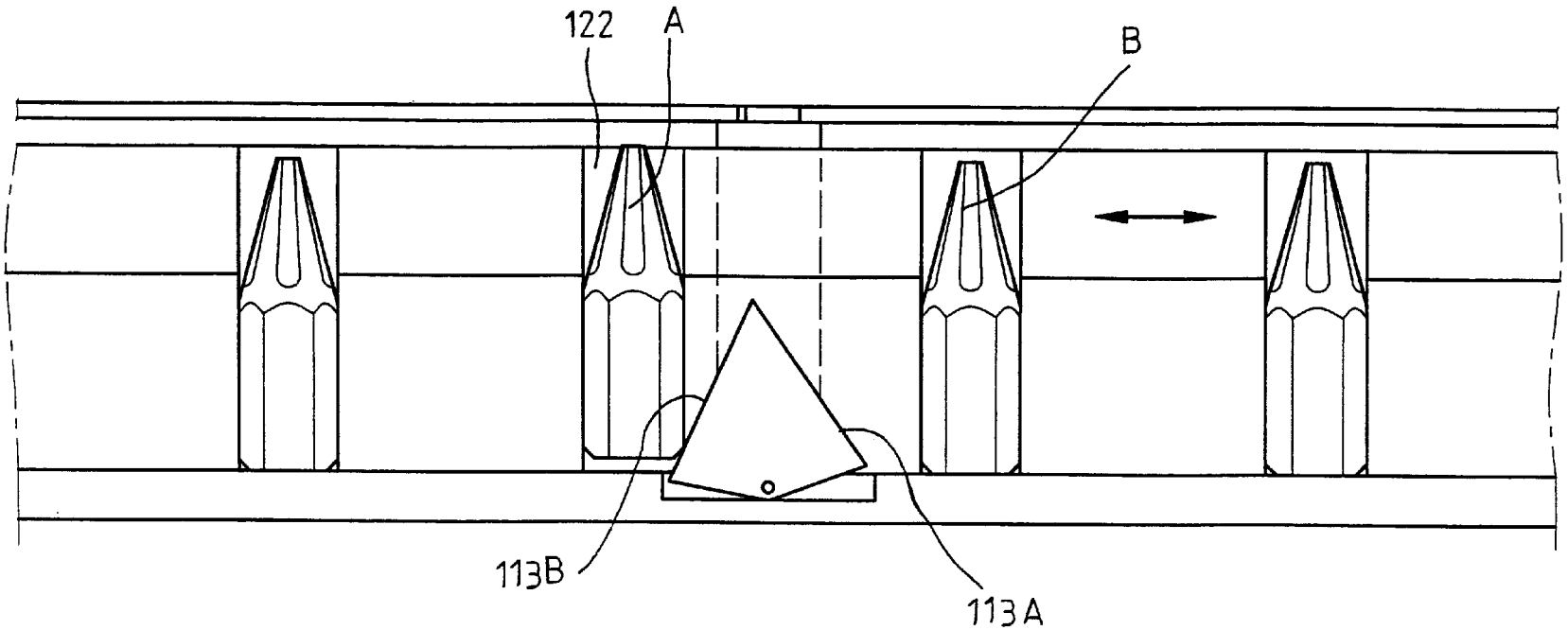
FIG. 7 shows a schematic plan view of the descending effect of the first preferred embodiment of the present invention.
Figure 8:
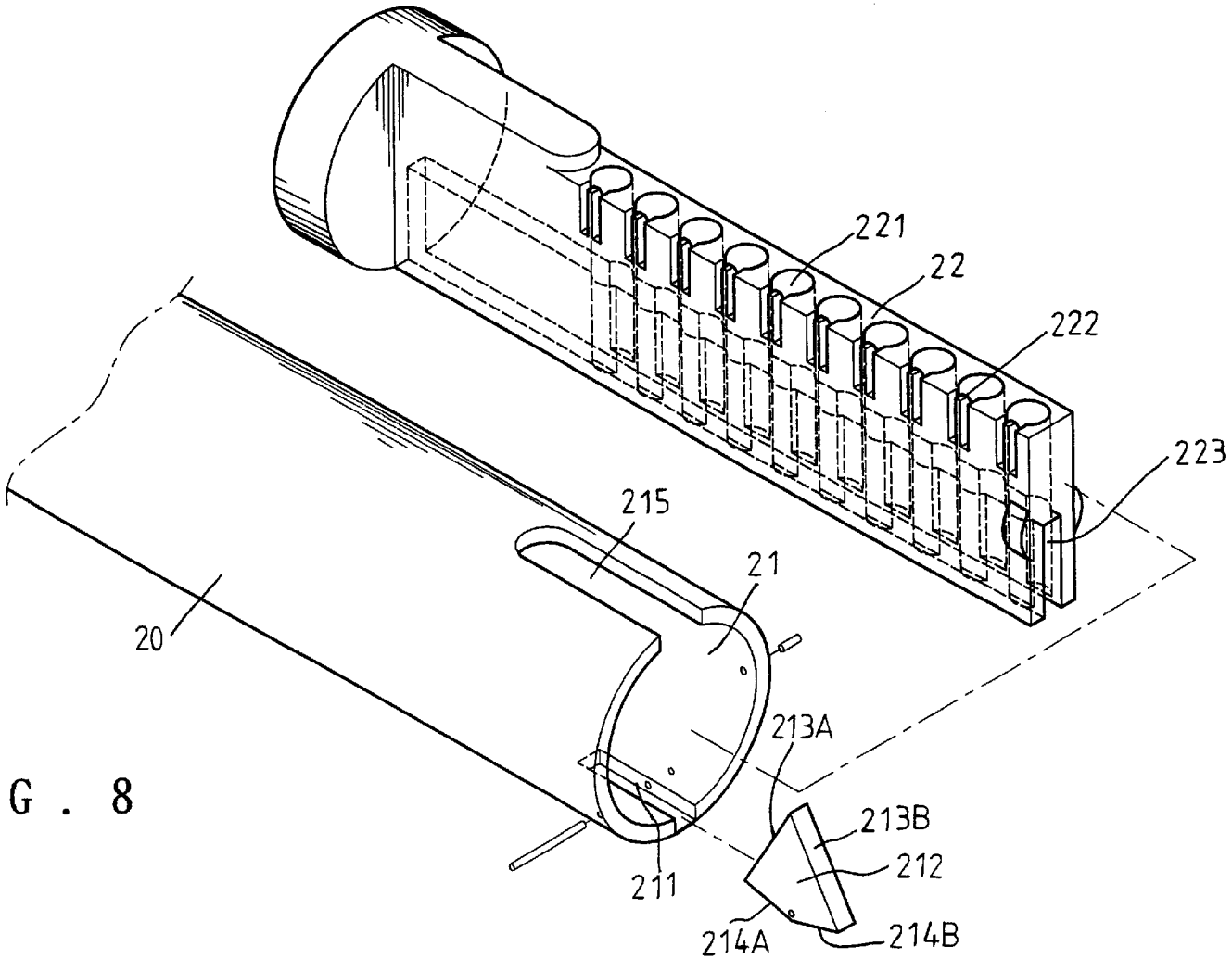
FIG. 8 shows an exploded view of a second preferred embodiment of the present invention.
Figure 9:
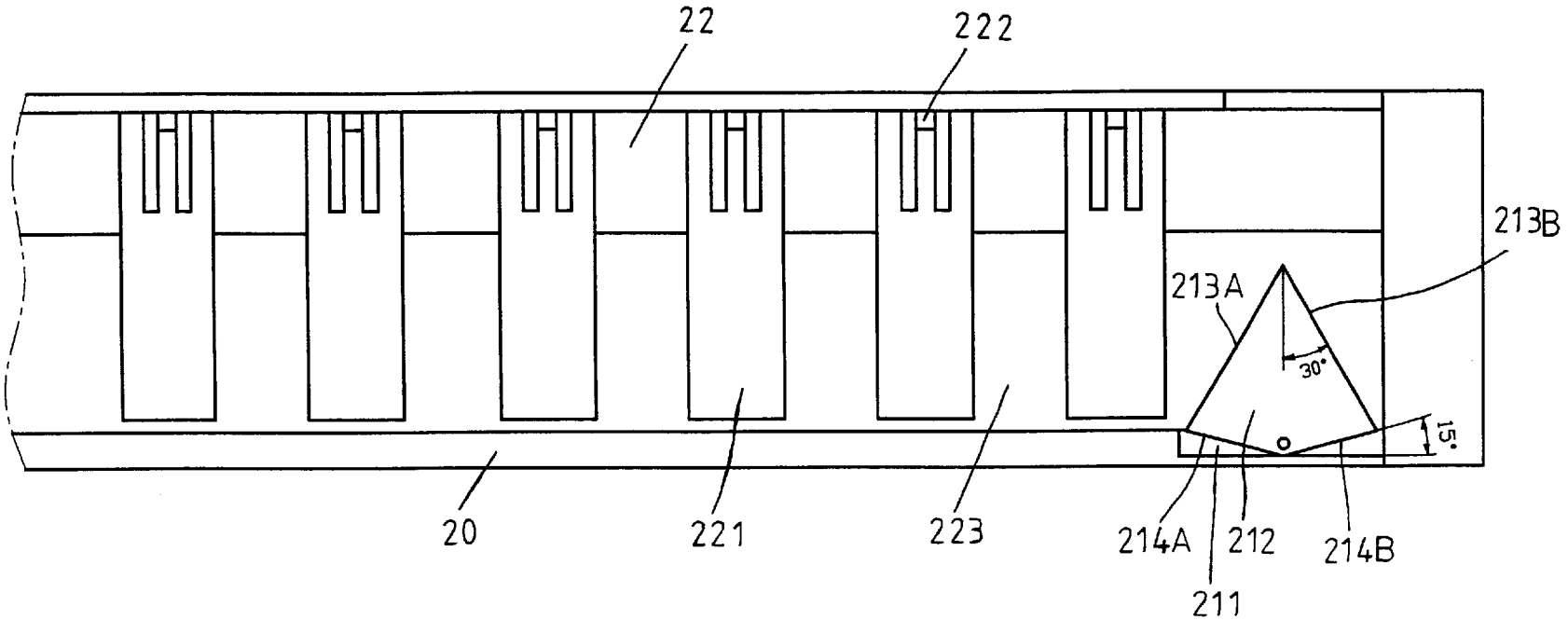
FIG. 9 shows a schematic plan view of the second preferred embodiment of the present invention.
Figure 10:
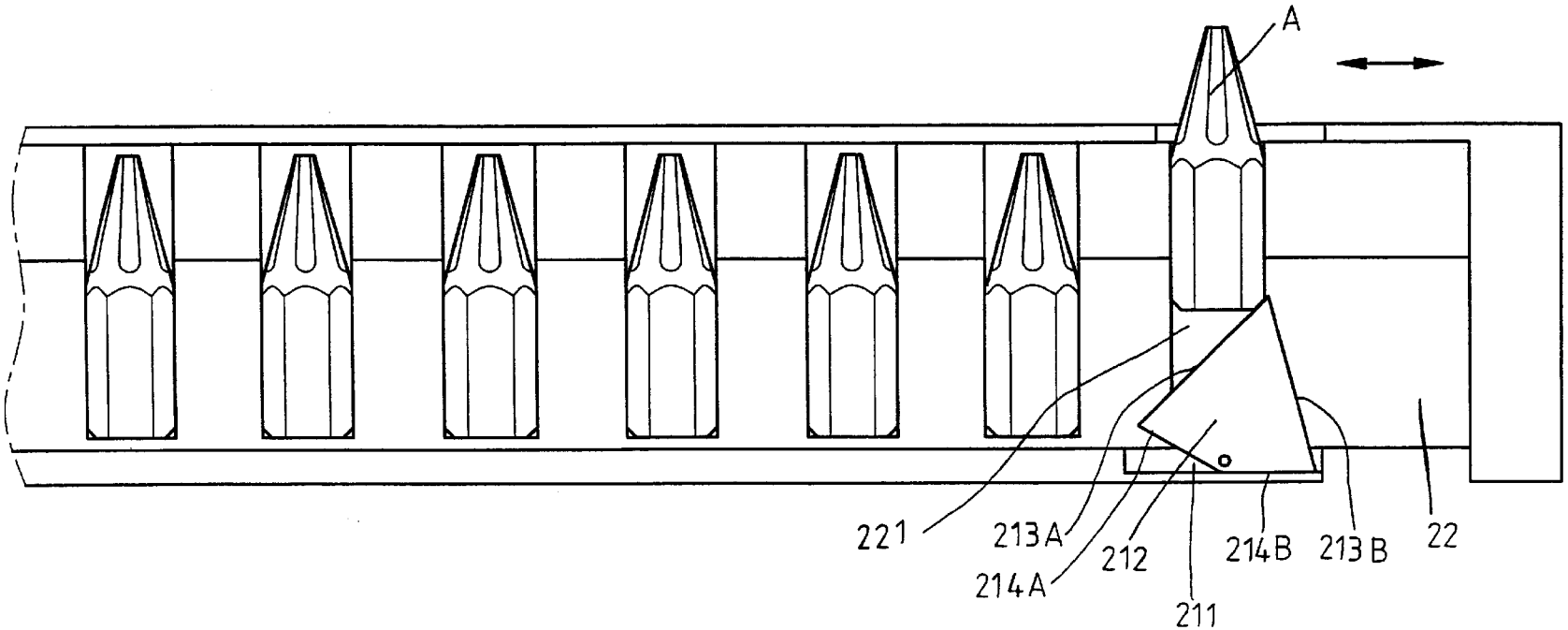
FIG. 10 shows a schematic plan view of the second preferred embodiment of the present invention at work.
Figure 11:
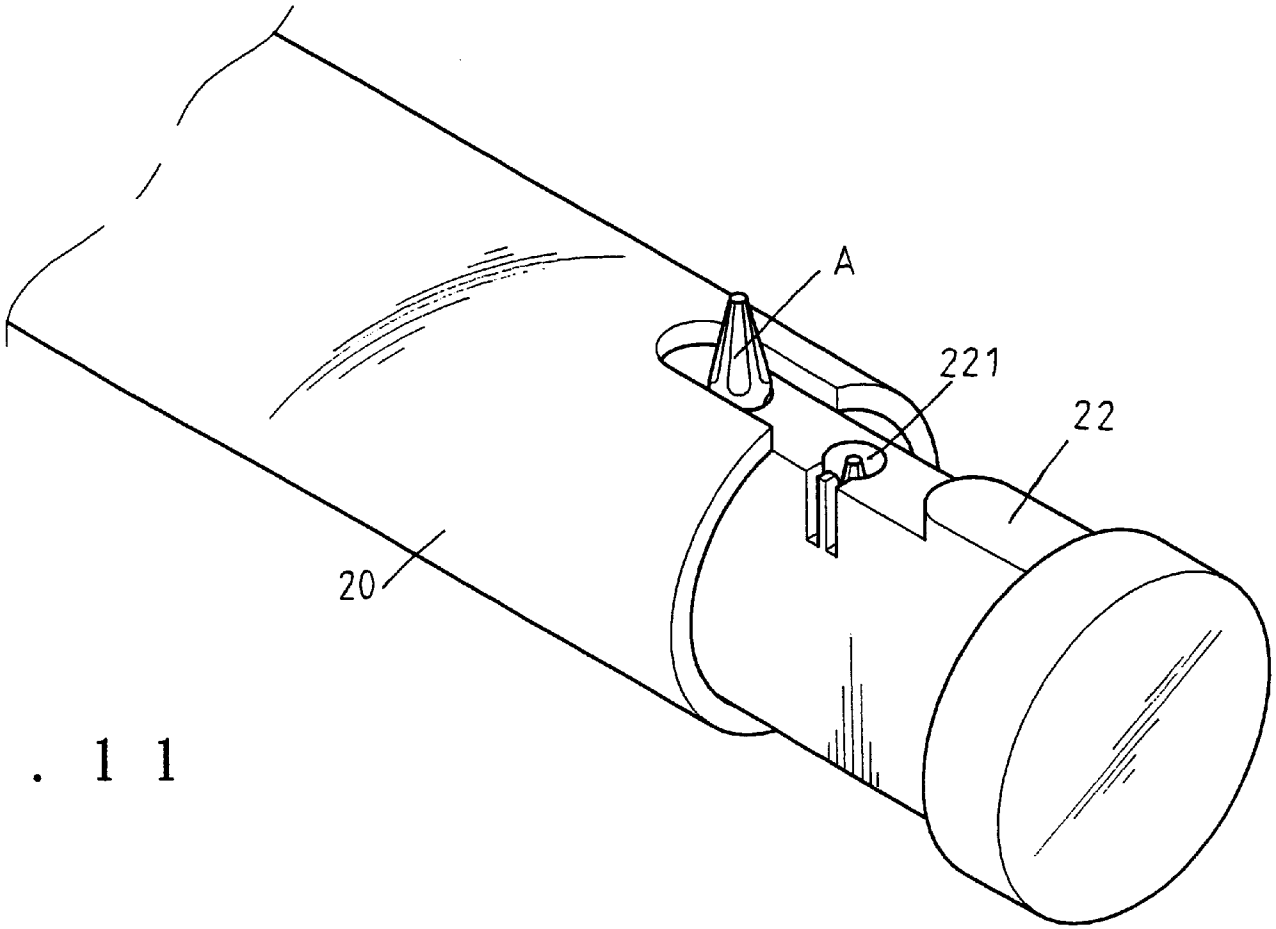
FIG. 11 shows a perspective view of the second preferred embodiment of the present invention.

As shown in FIG. 7, when the turning part "A" moves is beyond the top edge of the first action inclined face 113A, the turning part "A" descends along the second action inclined face 113B.

As shown in FIGS. 8–11, a drawer-type storage device embodied in the present invention comprises a cylindrical housing 20 and a sliding seat 22 which is slidably disposed in a hollow interior 21 of the housing 20. The cylindrical housing 20 may be the handle of a hand tool, such as screwdriver.

The housing 20 is provided in the inner wall of the open end thereof with a locating slot 211 in which an urging block 212 is movably located. The housing 20 is further provided with a through slot 215 of a predetermined length and extending from the open end of the housing 20 in the longitudinal direction of the housing 20. The urging block 212 is provided with a first action inclined face 213A and a second action inclined face 213B contiguous to the first action inclined face 213A. Both the first action inclined face 213A and the second action inclined face 213B have an inclination of 30 degrees. The urging block 212 is pivoted at the bottom end in the locating slot 211. The bottom end of the urging block 212 is provided with a first offset inclined face 214A contiguous to the first action inclined face 213A, and a second offset inclined face 214B contiguous to the first offset inclined face 214A and the second action inclined face 213B. Both the first offset inclined face 214A and the second offset inclined face 214B have an inclination of 15 degrees.

The sliding seat 22 is provided with a series of retaining slots 221 and an insertion slot 223 in communication with the retaining slots 221. The retaining slots 221 is provided at the top end with a position confining rib 222. The sliding seat 22 is slidably disposed in the housing 20 such that the retaining slots 221 are corresponding in location to the through slot 215 of the housing 20, and that the insertion slot 223 is corresponding in location to the urging block 212, and further that the sliding seat 20 can be drawn out and then pushed back into place.

The operating mechanism of the drawer-type storage device of the present invention is identical with that of the rotary storage device of the present invention described above with reference to FIGS. 2–7.

The embodiments of the present invention described above are to be regarded in all respects as being illustrative and nonrestrictive. Accordingly, the present invention may be embodied in other specific forms with deviating from the spirit thereof. The present invention is therefore to be limited only by the scopes of the following claims.

What is claimed is:

1. A rotary storage device for keeping the turning parts of a hand tool, said rotary storage device comprising:

a base provided in an upper side with a central axis of a length and extending uprightly therefrom, said base further provided in the upper side with a plurality of locating slots arranged at an interval, and a plurality of urging blocks which are pivoted at a bottom end thereof in said locating slots and are provided with a first action inclined face and second action inclined face contiguous to said first action inclined face and corresponding in inclination to said first action inclined face; and a rotating seat provided in an interior with a center through hole, a series of retaining slots and insertion slots in communication with said retaining slots, said rotating seat being rotatably mounted on said base such that said center through hole is fitted with said central axis of said base, and that said rotating seat turns around said central axis of said base, and that said insertion slots of said rotating seat are corresponding in location to said urging blocks of said base, said retaining slots of said rotating seat being used for keeping the turning parts of the hand tool in such a manner that the turning parts are urged by said urging blocks of said base to ascend along said first action inclined face or said second action inclined face of said urging blocks at such time when said rotating seat is turned around said central axis of said base;

wherein said urging blocks of said base are provided in the bottom end thereof with a first offset inclined face, and a second offset inclined face contiguous to said first offset inclined face and corresponding in inclination to said first offset inclined face.

2. The rotary storage device as defined in claim 1, wherein said first offset inclined face and said second offset inclined face of said urging blocks have an inclination of 15 degrees; wherein said first action inclined face and said second action inclined face of said urging blocks have an inclination of 30 degrees.

3. A drawer-type storage device for keeping the turning parts of a hand tool, said device comprising:

a housing of a length and having a hollow interior with an open end, said housing being provided in an inner wall of said open end thereof with a locating slot and an urging block which is pivoted at a bottom end thereof in said locating slot, said locating slot having a length and extending from said open end along the longitudinal direction of said housing, said urging block being provided with a first action inclined face and a second action inclined face contiguous to said first action inclined face and corresponding in inclination to said first action inclined face; and a sliding seat provided with a series of retaining slots and an insertion slot in communication with said retaining slots, said sliding seat being slidably disposed in said hollow interior of said housing such that said insertion slot of said sliding seat is corresponding in location to said urging block of said housing, said retaining slots of said sliding seat being used for keeping the turning parts of the hand tool in such a manner that the turning parts are urged by said urging block of said housing to ascend along said first action inclined face or said second action inclined face of said urging block at such time when said sliding seat is drawn out and then pushed back into place;

wherein said urging block of said housing is provided in the bottom end thereof with a first offset inclined face, and a second offset inclined face contiguous to said first offset inclined face and corresponding in inclination to said first offset inclined face.

4. The drawer-type storage device as defined in claim 3, wherein said first action inclined face and said second action inclined face of said urging block have an inclination of 30 degrees; wherein said first offset inclined face and said second offset inclined face of said urging block have an inclination of 15 degrees.

* * * * *